US008543316B2

(12) United States Patent
Takigawa et al.

(10) Patent No.: US 8,543,316 B2
(45) Date of Patent: Sep. 24, 2013

(54) AIR FUEL RATIO CONTROL DEVICE OF ENGINE

(75) Inventors: Buso Takigawa, Kanagawa-ken (JP); Umerujan Sawut, Atsugi (JP); Tohti Gheyret, Atsugi (JP)

(73) Assignee: Nikki Co., Ltd., Kanagawa-Ken (JP)

( * ) Notice: Subject to any disclaimer, the term of this patent is extended or adjusted under 35 U.S.C. 154(b) by 326 days.

(21) Appl. No.: 13/064,666

(22) Filed: Apr. 7, 2011

(65) Prior Publication Data

US 2011/0257871 A1 Oct. 20, 2011

(30) Foreign Application Priority Data

Apr. 16, 2010 (JP) ..... 2010-94878

(51) Int. Cl.
*F02D 41/00* (2006.01)

(52) U.S. Cl.
USPC ..... 701/104; 701/110; 123/676; 123/704

(58) Field of Classification Search
USPC ..... 701/103–105, 110; 123/672, 676, 123/704, 436
See application file for complete search history.

(56) References Cited

FOREIGN PATENT DOCUMENTS

| | | | |
|---|---|---|---|
| JP | 64-87841 | * | 3/1989 |
| JP | 64-87842 | * | 3/1989 |
| JP | 07-208139 | | 8/1995 |
| JP | 10-288075 | | 10/1998 |
| JP | 11-294230 | * | 10/1999 |
| JP | 2010-203320 | * | 9/2010 |
| JP | 211-226328 | * | 11/2011 |

* cited by examiner

*Primary Examiner* — Hai Huynh
(74) *Attorney, Agent, or Firm* — Rader, Fishman & Grauer PLLC

(57) ABSTRACT

An air-fuel ratio control device comprising a fuel supply unit, engine operation state detector, air-fuel ratio information detector, and an electronic control unit is disclosed. The electronic control unit determines a fuel injection amount which realizes a target air-fuel ratio while using engine load information by the engine operation state detector on the basis of air-fuel ratio information by the air-fuel ratio information detector, and then outputs a driving signal to the fuel supply unit, to execute feedback control mainly at an excessively rich side air-fuel ratio, characterized in that the air-fuel ratio information detector is an exhaust gas temperature sensor.

18 Claims, 11 Drawing Sheets

1A

1A

1B

1C

AIR FUEL RATIO CONTROL DEVICE OF ENGINE

BACKGROUND OF THE INVENTION

1. Field of the Invention

The present invention relates to an air-fuel ratio control device of an engine, and more particularly, it relates to an air-fuel ratio control device which executes feedback control at an air-fuel ratio on an excessively rich side in an industrial engine.

2. Description of Related Art

In a fuel supply system of an engine, an air-fuel ratio control device determines a fuel injection amount which realizes an optimum air-fuel ratio, on the basis of data of a detected engine operation state, to supply a fuel to the engine via fuel supply means such as a fuel injection valve, whereby feedback control of the air-fuel ratio is usually executed.

FIG. 8 shows an example of a constitution of an air-fuel ratio control device 1E which executes such an air-fuel ratio feedback system. A suction tube pressure sensor 15 disposed in a suction passage 3, and an engine rotation number sensor 14, an engine temperature sensor 13 and the like disposed for an engine 2 input detection signals into an electronic control unit 10C. The control unit calculates a fuel injection amount which realizes a target air-fuel ratio on the basis of various pieces of information of these signals, and outputs the amount as a fuel injection valve driving signal to a fuel injection valve 5 to control the air-fuel ratio.

However, it is known that an error is generated between the target air-fuel ratio and an actual air-fuel ratio owing to various factors such as product fluctuations, deterioration with time, and disturbance. Therefore, for the purpose of eliminating this error, an $O_2$ sensor is disposed in an exhaust gas passage as in an air-fuel ratio control device disclosed in JP-A-7-208139, or an air-fuel ratio sensor 12 is disposed in an exhaust gas passage 4 as in the air-fuel ratio control device 1E described above and disclosed in JP-A-10-288075, whereby control is executed on the basis of a detected actual air-fuel ratio in many cases.

FIG. 9 shows a control block diagram by such an air-fuel ratio control device. The device multiplies basic injection pulse information Tp calculated on the basis of a suction air amount (C1) by a correction amount a calculated on the basis of air-fuel ratio information A/F by an air-fuel ratio sensor or an $O_2$ sensor (C4), multiplies the result by other correction amounts K1 and K2 or adds the amounts, and outputs the result as a final pulse width Ti to the fuel injection valve 5, thereby executing the feedback control of the air-fuel ratio.

FIG. 10 is a graph showing output characteristics of the $O_2$ sensor and the air-fuel ratio sensor. In the $O_2$ sensor, a voltage noticeably changes around a theoretical air-fuel ratio, and the air-fuel ratio sensor exhibits nearly linear characteristics in accordance with the air-fuel ratio. However, in a car in which an exhaust gas is purified by using a ternary catalyst, control is executed around the theoretical air-fuel ratio at which a catalyst purification efficiency is highest. Therefore, the target air-fuel ratio can be realized by using either of the $O_2$ sensor and the air-fuel ratio sensor.

On the other hand, in an industrial engine having a comparatively small displacement for use in a power generator, a lawn mower or the like, for request from a cost aspect in addition to the purposes of protecting the engine and acquiring safety of the engine, a catalyst purification device is not used but an air-fuel ratio is controlled so as to be on an excessively rich side from a theoretical air-fuel ratio, thereby decreasing nitrogen oxides in an exhaust gas. However, at the excessively rich side air-fuel ratio, an $O_2$ sensor cannot be used owing to a problem of sensitivity, and an air-fuel ratio sensor having linear output characteristics is used, so that a steep rise of system cost is incurred.

SUMMARY OF THE INVENTION

The present invention has been developed to solve the above problem, and an object thereof is to provide an air-fuel ratio control device in which when feedback control of an air-fuel ratio is executed on an excessively rich side, a high rise of cost is not incurred but a target air-fuel ratio can precisely be realized.

To achieve the above object, according to the present invention, there is provided an air-fuel ratio control device comprising: fuel supply means; engine operation state detection means; air-fuel ratio information detection means; and an electronic control unit, the electronic control unit being configured to determine a fuel injection amount which realizes a target air-fuel ratio while using engine load information by the engine operation state detection means on the basis of air-fuel ratio information by the air-fuel ratio information detection means, and then output a driving signal to the fuel supply means, to execute feedback control mainly at an excessively rich side air-fuel ratio, characterized in that the air-fuel ratio information detection means is an exhaust gas temperature sensor, and while estimating an air-fuel ratio at this time on the basis of detected exhaust gas temperature information by a predetermined obtaining method, the air-fuel ratio is used for the control.

It is known that an exhaust gas temperature is highest around a theoretical air-fuel ratio at which a burning efficiency is highest, and the temperature tends to substantially linearly lower, when the air-fuel ratio becomes excessively rich. A correlation is seen between the exhaust gas temperature and the air-fuel ratio, whereby the air-fuel ratio can comparatively easily be estimated by using this correlation. Therefore, when the feedback control is executed at the excessively rich side air-fuel ratio by use of the exhaust gas temperature sensor as the air-fuel ratio information detection means, an expensive air-fuel ratio sensor is not used but precise control can be executed.

Moreover, this air-fuel ratio control device is characterized in that the air-fuel ratio is obtained on the basis of the exhaust gas temperature information by use of a map or a formula beforehand obtained on the basis of the result of acquired information on an exhaust gas temperature and the air-fuel ratio at this time in a plurality of engine operation state with respect to a target engine, stored in storage means of the electronic control unit, and indicating a relation between the exhaust gas temperature and the air-fuel ratio, whereby a processing burden on the electronic control unit does not become excessively large but the air-fuel ratio can accurately be estimated in a short time.

Furthermore, the above air-fuel ratio control device is characterized in that for the feedback control, the exhaust gas temperature during an operation at a target air-fuel ratio is estimated and calculated by two-dimensional interpolation or a polynomial approximate formula to obtain a target temperature, on the basis of engine rotation number information and a plurality of pieces of engine load information, and the feedback control is executed while regulating a fuel supply amount so that the exhaust gas temperature converges to this target temperature, whereby accurate feedback control can easily be realized.

In this case, engine temperature detection means is provided, and an engine warm-up level is estimated and calculated on the basis of the detected engine temperature information by one-dimensional interpolation or a polynomial approximate formula, and added to or subtracted from the calculated target temperature to correct the target temperature, whereby precise feedback control can be realized.

Furthermore, the air-fuel ratio control device having the above system to calculate the target temperature is characterized by calculating the exhaust gas temperature which varies with the target air-fuel ratio by one-dimensional interpolation or a polynomial approximate formula, and adding or subtracting the exhaust gas temperature to or from the calculated target temperature to correct the target temperature, whereby more precise feedback control can be realized.

In addition, the air-fuel ratio control device having the above system to calculate the target temperature is characterized by subjecting the calculated target temperature to response delay processing identified with a primary delay plus dead time system, by use of a time constant calculated on the basis of the engine rotation number information and the engine load information by two-dimensional interpolation or a polynomial approximate formula, whereby more precise feedback control can be realized.

Moreover, the air-fuel ratio control device having the above system to calculate the target temperature is characterized by judging that the engine is being warmed up to stop the execution of the feedback control, in a case where the calculated target temperature is lower than a predetermined temperature, whereby the device can handle various engine operation situations. Furthermore, the air-fuel ratio control device having the above system to calculate the target temperature judges that the engine causes an accidental fire to stop the execution of the feedback control, in a case where in the detected engine rotation number information, a rotation fluctuation is larger than a predetermined reference, whereby the device also easily handles various engine operation situations.

In addition, the above air-fuel ratio control device is characterized in that the fuel supply means is an electronic control carburetor including an actuator operating type fuel flow ratio regulating section operated by the electronic control unit, whereby the device exerts a function in the same manner as in a case where the fuel supply means is a fuel injection valve.

According to the present invention in which the exhaust gas temperature sensor is used in the air-fuel ratio information detection means, when the air-fuel ratio feedback control is executed on an excessively rich side, a steep rise of cost is not incurred but the target air-fuel ratio can precisely be realized.

DESCRIPTION OF THE PREFERRED EMBODIMENTS

Hereinafter, an embodiment of the present invention will be described with reference to the drawings. It is to be noted that as an engine which is a control target of the present embodiment, there is considered an engine having a comparatively small displacement for a power generator, a lawn mower or the like, i.e., a so-called industrial engine. It is considered that an air-fuel ratio is feedback-controlled on an excessively rich side to decrease harmful substances such as nitrogen oxides in an exhaust gas without using any catalyst purification device.

Figure 1:
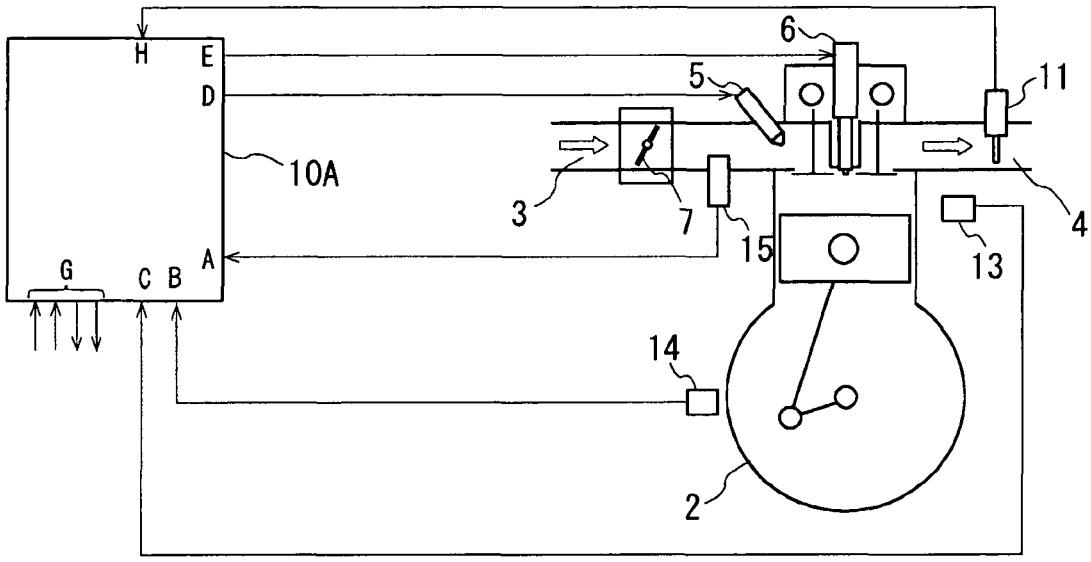
FIG. 1 is an arrangement diagram showing a constitution of an air-fuel ratio control device of an embodiment in the present invention.
Figure 8:
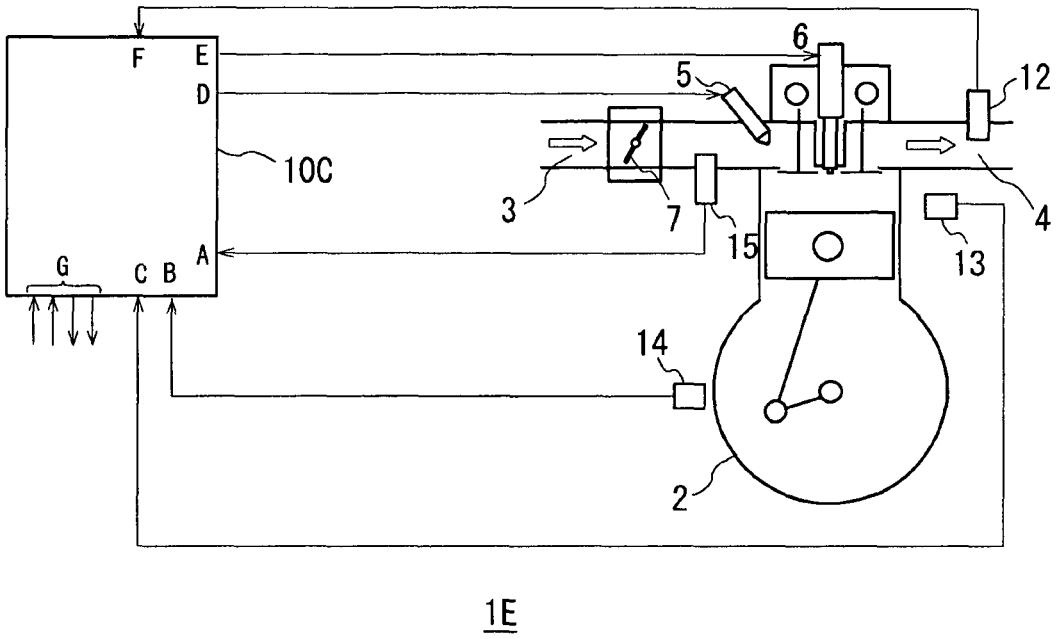
FIG.8 PRIOR ART
FIG. 8 is an arrangement diagram showing a constitution of an air-fuel ratio control device of a conventional example.
Figure 9:
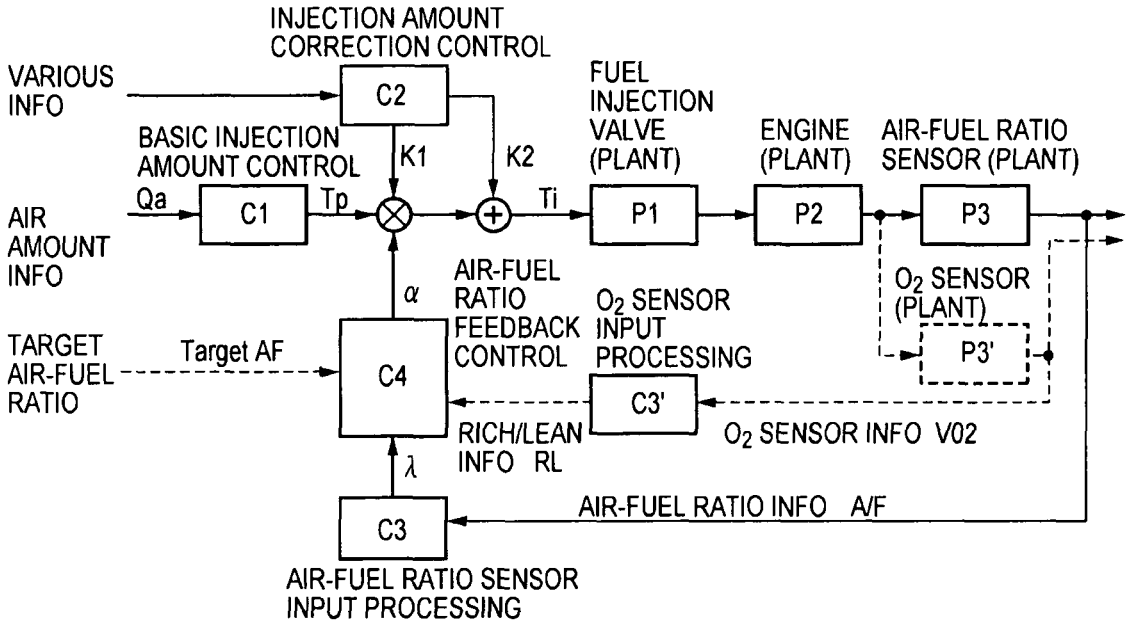
FIG.9 PRIOR ART
FIG. 9 is a control block diagram by the air-fuel ratio control device of FIG. 8.
Figure 10:
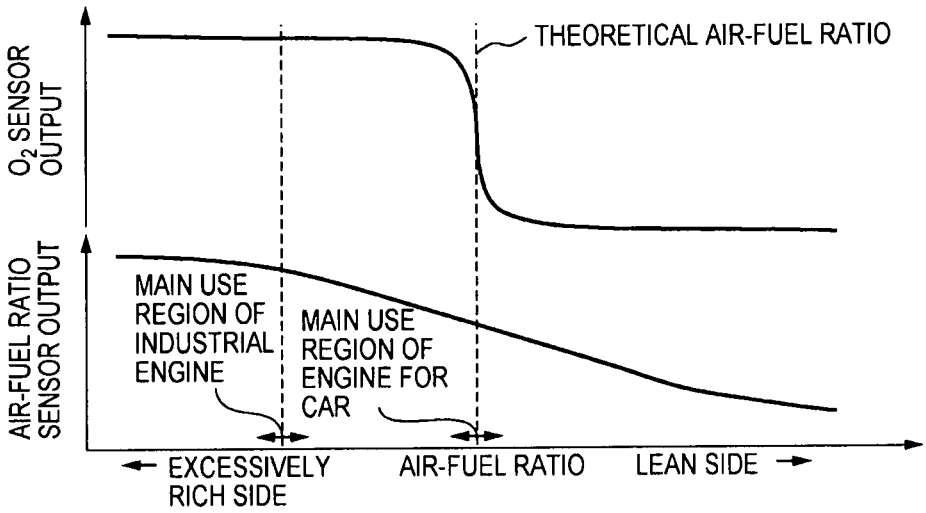
FIG.10 PRIOR ART
FIG. 10 is a graph showing output characteristics of an $O_2$ sensor and an air-fuel ratio sensor.

FIG. 1 shows a constitution of an air-fuel ratio control device 1A of the present embodiment. The constitution is basically common with a conventional example shown in FIG. 8. However, the constitution is characterized in that in place of an expensive air-fuel ratio sensor 12 disposed in an exhaust gas passage 4 of FIG. 8, a comparatively inexpensive exhaust gas temperature sensor 11 is disposed to output a detection signal to an electronic control unit 10A and the electronic control unit 10A estimates an air-fuel ratio on the basis of exhaust gas temperature information.

Figure 11:
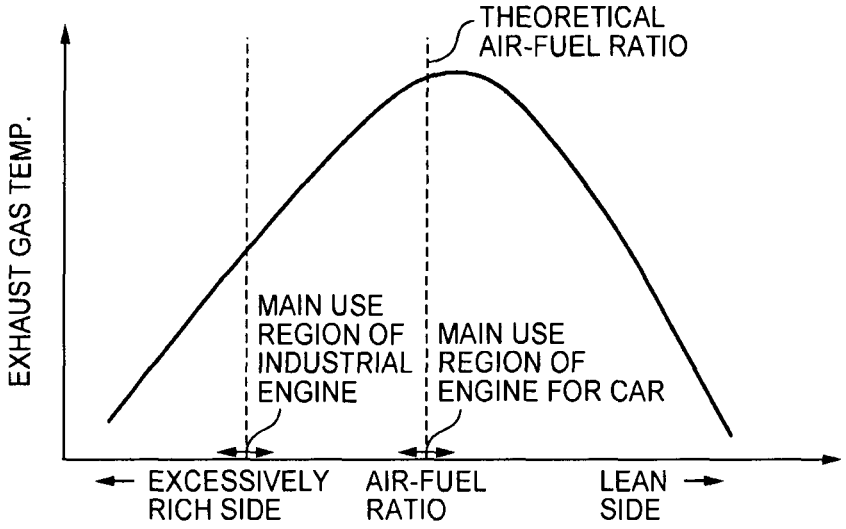
FIG. 11 is a graph showing a relation between an exhaust gas temperature and an air-fuel ratio.

That is, a relation between the air-fuel ratio and an exhaust gas temperature generally has a tendency as shown in FIG. 11. The temperature is highest near a theoretical air-fuel ratio. The more excessively rich the air-fuel ratio is, the lower the temperature becomes. Therefore, concerning air-fuel ratio control of an engine 2 which is an industrial engine having a main use region on an excessively rich side, the above tendency is utilized to calculate the air-fuel ratio on the basis of a detected exhaust gas temperature, thereby executing the control in the electronic control unit 10A.

Figure 2:
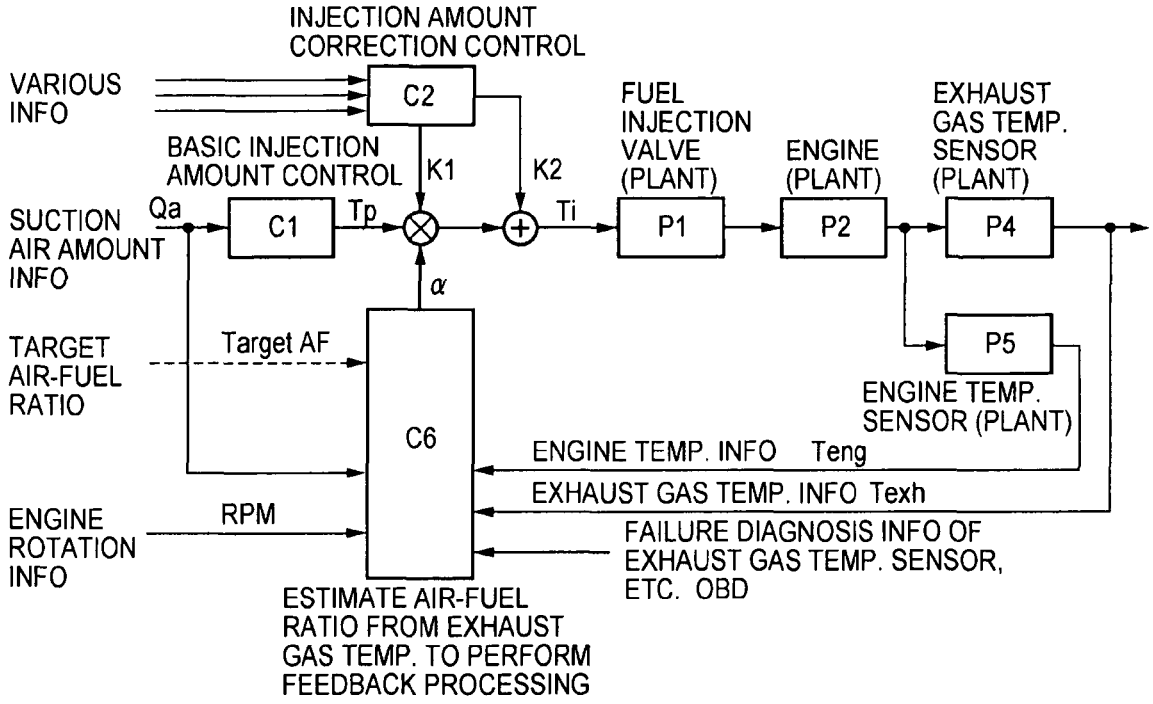
FIG. 2 is a control block diagram by the air-fuel ratio control device of FIG. 1.

A summary of the feedback control of the device will be described with reference to a control block diagram of FIG. 2. There are input, into an estimating calculating block (C6), main input information such as engine operation state information including exhaust gas temperature information (Texh) detected by the exhaust gas temperature sensor 11 (P4), target air-fuel ratio information (Target AF), engine rotation number information (RPM), suction air amount information (Qa), engine temperature information (Teng) detected by an engine temperature sensor 13 (P5), sensor failure information (OBD) and the like, to calculate an air-fuel ratio feedback correction coefficient ($\alpha$).

When a basic injection pulse width (Tp) is multiplied by this correction coefficient ($\alpha$) in the same manner as in a conventional system, program is not noticeably changed but accurate air-fuel ratio feedback control can be realized. Moreover, the block (C6) which thus estimates the air-fuel ratio on the basis of the exhaust gas temperature to calculate the feedback correction coefficient first calculates a basic exhaust gas temperature (Texbs) when the engine is operated at a target air-fuel ratio on the basis of the suction air amount information (Qa) and the engine rotation number information (RPM) as shown in the detailed control block diagram of FIG. 3.

As to this basic exhaust gas temperature (Texbs), a test is beforehand conducted to operate the engine in a plurality of engine operation states with engine rotation numbers and on engine load conditions, thereby beforehand recording exhaust gas temperatures. When the basic exhaust gas temperature (Texbs) is calculated from the result, the temperature is obtained by two-dimensional interpolation (hereinafter referred to as "the map interpolation") (C6-1) or calculated by a polynomial approximate formula, from the engine rotation number information (RPM) and additional information (Qa).

On the other hand, for the purpose of correcting influence of an engine peripheral temperature, also in consideration of a case where a value obtained from the engine temperature information (Teng) by one-dimensional interpolation (hereinafter referred to as "the table interpolation") and the target air-fuel ratio are slightly changed, a value similarly obtained from the target temperature by the table interpolation is acquired as a temperature correction value (Texcr) (C6-2), and added to the basic exhaust gas temperature (Texbs) (C6-3) (according to circumstances, a minus (−) correction value may be added).

Here, a time constant is obtained on the basis of the suction air amount information (Qa) and the engine rotation number information (RPM) by the map interpolation or the like, and this value is subjected to primary delay system filter processing (C6-4), thereby calculating a target exhaust gas temperature (Texd) in consideration of a transient change. An actually measured exhaust gas temperature (Texh) is subtracted from this target exhaust gas temperature (Texd) (C6-5) to calculate an error (Terr), and a feedback control section (C6-6) calculates an air-fuel ratio feedback coefficient ($\alpha$) so that the error becomes zero. An algorithm of this feedback control section can be constituted of PI control or PID control for use in usual air-fuel ratio feedback control. When the error (Terr) is plus, increasing calculation is performed. When the error is minus, decreasing calculation is performed.

Moreover, the exhaust gas temperature is utilized for the present control in consideration of a reaction during normal burning in a cylinder. Therefore, the air-fuel ratio control device has a function of stopping the feedback control (FBstop), when burning is not normally performed or failure is judged (OBD). This device has a function (C6-7) of judging that an accidental fire occurs in a case where a cycle fluctuation is larger than the engine rotation number information (RPM); a function (C6-9) of judging a control direction from the change of the exhaust gas temperature (Texh) and temperature error information (Terr) to judge that the air-fuel ratio is lean, because the excessively rich side and a lean side have reverse characteristics on the border of an excessively rich air-fuel ratio judged from a rotation fluctuation and error information (Terr) (see FIG. 11); and a function (C6-10) of judging that the engine is being warmed up in a case where the target temperature (Texd) is low, because the exhaust gas temperature does not sufficiently rise or the fluctuation of the target air-fuel ratio is large sometimes during the warm-up. The device has a function of stopping the feedback control (FBstop) on conditions of a theoretical sum (OR) of all the above conditions (C6-11).

Furthermore, when the feedback control is stopped, the correction coefficient is fixed to be none ($\alpha$=1.0). However, when the control is stopped owing to the lean judgment (C6-9), the correction coefficient is fixed to be on an increase side (e.g., $\alpha$=1.25). When it is judged that the burning is unstable owing to the excessively rich ratio (C6-8), the correction coefficient is reset to a default value (e.g., $\alpha$=1.0). The device is provided with a function of improving convergent properties of the air-fuel ratio control.

Figure 3:
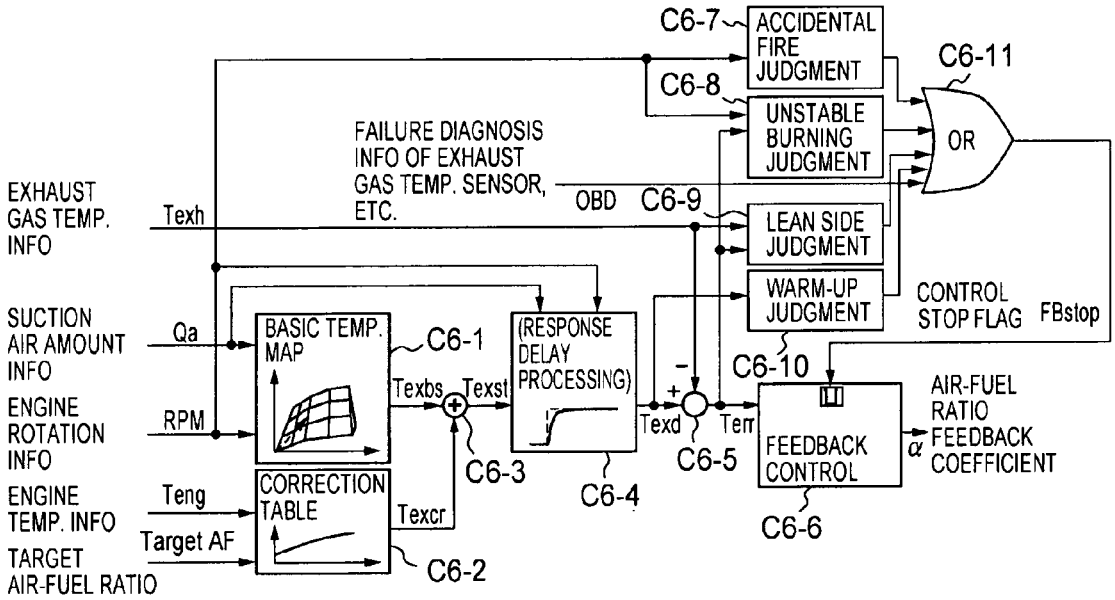
FIG. 3 is a control block diagram showing details of feedback processing in control of FIG. 1.
Figure 4:
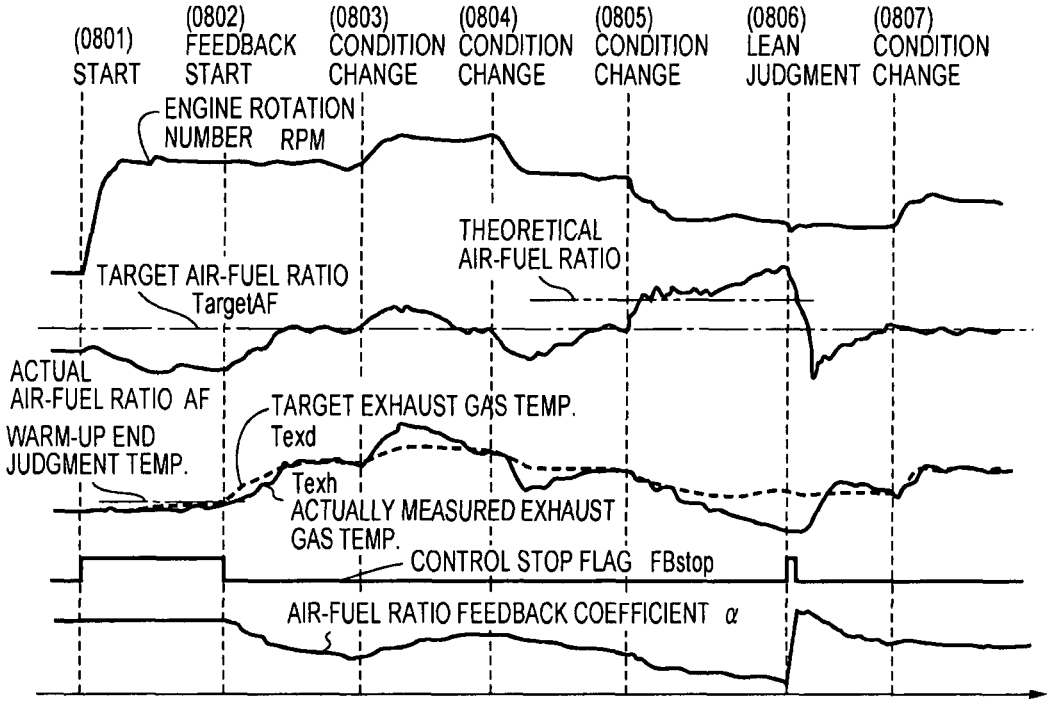
FIG. 4 is a graph showing an operation example of air-fuel ratio feedback control by the air-fuel ratio control device of FIG. 1.

Next, an operation of the present embodiment will be described with reference to a graph of an operation example of FIG. 4 in addition to FIG. 3. After the start of the engine (0801), both the actually measured exhaust gas temperature (Texh) and the target exhaust gas temperature (Texd) obtained by the above calculation method rise, but the target exhaust gas temperature (Texd) is not higher than a predetermined value. In consequence, it is judged that the engine is being warmed up (C6-10), to stop the feedback control (FBstop).

Afterward, when the temperature rises and the warm-up judgment (C6-10) does not work (FBstop=0), the feedback control is started (0802). In the case of this example, the actually measured exhaust gas temperature (Texh) is lower than the target exhaust gas temperature (Texd). Therefore, it is judged that an actual air-fuel ratio (AF) is richer than a target air-fuel ratio (TargetAF), and the correction coefficient ($\alpha$) is gradually decreased by the feedback control (C6-6). This operation continues until a difference between the target exhaust gas temperature (Texd) and the exhaust gas temperature (Texh) becomes zero, whereby the air-fuel ratio converges to a target value.

Next, when operation conditions are changed by acceleration (0803), the target exhaust gas temperature (Texd) gradually changes to a higher value in accordance with a basic temperature map (C6-1) or response delay processing (C6-4). On the other hand, when the actually measured exhaust gas temperature (Texh) indicates a further higher value, it is judged that the air-fuel ratio is leaner than the target air-fuel ratio, to gradually increase the correction coefficient ($\alpha$) by the feedback control (C6-6), thereby regulating the error (Terr) so that the error becomes zero in the same manner as described above. In consequence, the air-fuel ratio converges to the target value.

Then, when the operation conditions of the engine are changed by deceleration (0804), the target air-fuel ratio (Texd) slowly changes to be a lower value in the same manner as described above. On the other hand, the actually measured exhaust gas temperature (Texh) is further low, and hence it is judged that the air-fuel ratio is rich. By the feedback control, the correction coefficient ($\alpha$) is subtracted, so that the air-fuel ratio finally converges to the target air-fuel ratio.

Afterward, when the operation conditions of the engine are changed (0805), the target exhaust gas temperature (Texd) further becomes low, but the actually measured exhaust gas temperature (Texh) is further lower. Therefore, it is judged through the above logic that the air-fuel ratio is rich, to perform an operation of decreasing the correction coefficient ($\alpha$) by the feedback control. However, at this time, the air-fuel ratio is actually leaner than the theoretical air-fuel ratio (reverse characteristic state) owing to deterioration of a fuel injection valve 5 or the like. Therefore, when the correction coefficient ($\alpha$) is decreased, the actual air-fuel ratio (AF) further becomes lean, thereby indicating a tendency that the actually measured exhaust gas temperature (Texh) further lowers.

When this state lasts long, the lean judgment (C6-9) of the above logic (see FIG. 3) works, to bring the feedback control into a primary stop (FBstop=1) state, thereby resetting the correction coefficient ($\alpha$) of the feedback control to a rich state ($\alpha$=1.25). In consequence, the actual air-fuel ratio returns to a richer state than the theoretical air-fuel ratio. Afterward, the feedback control is restarted (0806). However, since the actual air-fuel ratio is richer than the theoretical air-fuel ratio, it is judged that the characteristics are positive.

The air-fuel ratio control is executed as usual, so that the air-fuel ratio converges to the target air-fuel ratio. The conditions are also changed (0807), but this feedback control function is continuously performed so that the air-fuel ratio converges to the target air-fuel ratio. It is seen that a satisfactory air-fuel ratio control function is obtained.

Figure 5:
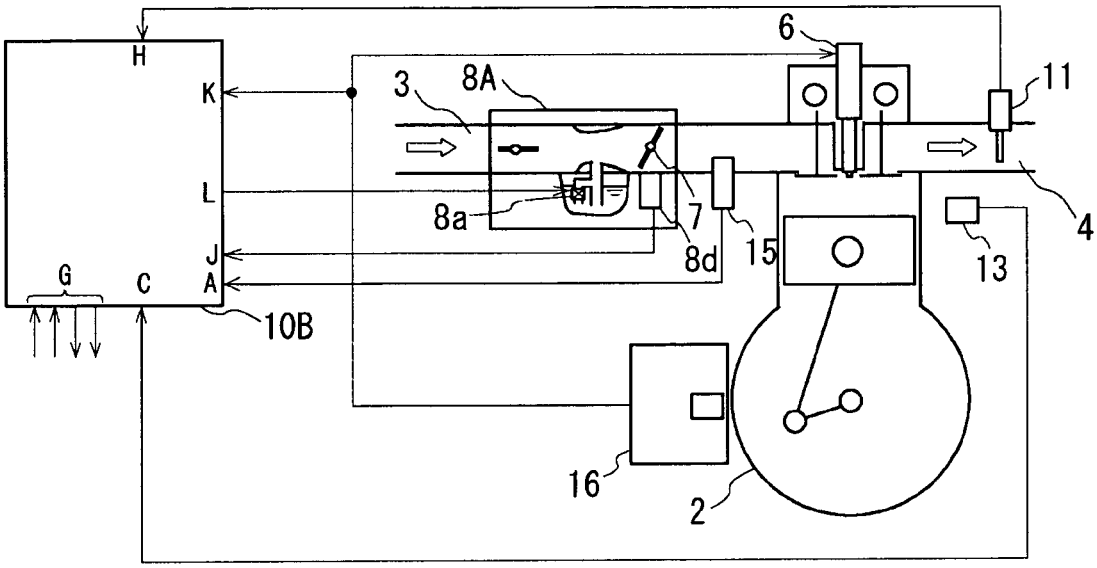
FIG. 5 is an arrangement diagram showing a constitution of an application example of the air-fuel ratio control device of FIG. 1.

Hereinafter, application examples of the air-fuel ratio control device 1A of FIG. 1 will be described with reference to FIG. 5 to FIG. 7. As shown in FIG. 5, in an air-fuel ratio control device 1B, the fuel injection valve 5 which is the fuel supply means of the air-fuel ratio control device 1A of FIG. 1 is replaced with an electronic control carburetor 8A. A constitution of the device inputs (H) an output signal of an exhaust gas temperature sensor 11 into an electronic control unit 10B, and inputs a driving signal into the electronic control carburetor 8A via an output (L) port on the basis of information on a correction coefficient ($\alpha$) calculated inside the unit, to control a fuel flow rate regulating actuator 8*a* of the carburetor.

The actuator 8*a* is an electromagnetic actuator such as a rotary solenoid or a linear solenoid, and the actuator is excited, when the electronic control unit 10B outputs a PWM signal (an ON/OFF energization time ratio control signal), whereby a temporal open area is controlled. Moreover, this actuator is installed in a sub fuel passage disposed so as to bypass an orifice (a fuel metering portion) made in a carburetor main fuel passage. When this actuator is operated by the PWM signal, a fuel flow rate can freely variably be controlled.

As to internal processing in the electronic control unit 10B, a block (C6) (see FIG. 2) which estimates an air-fuel ratio from an exhaust gas temperature to feed the ratio back as described above is used as it is, and a PWM on/off duty ratio is output to the actuator in accordance with a correction coefficient ($\alpha$), whereby control is realized in the same manner as in the above air-fuel ratio feedback control of a fuel injection system.

Moreover, as to engine load information, except for a suction tube pressure sensor 15 which has heretofore been used, a throttle open degree sensor 8*d* disposed in the electronic control carburetor 8A may be utilized. Furthermore, as to engine rotation number information, when an engine rotation number sensor 14 is not disposed, an ignition output of a magnet ignition unit 16 is taken into the electronic control unit 10B (K), which enables detection of the engine rotation number information. It is to be noted that except for the linear solenoid, a similar system utilizing a step motor is present as the fuel flow rate regulating actuator of the electronic control carburetor. Also in this case, when an on/off duty signal is controlled as a step number, needless to say, a similar effect can be obtained.

Figure 6:
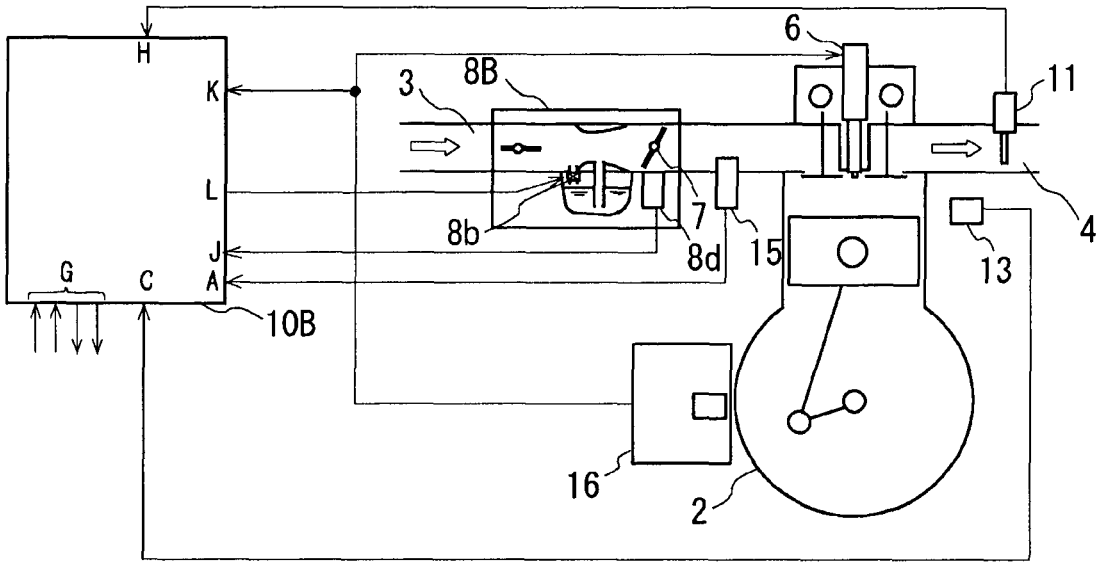
FIG. 6 is an arrangement diagram showing a constitution of another application example of the air-fuel ratio control device of FIG. 1.

FIG. 6 shows an air-fuel ratio control device 1C as another application example. This example also has a constitution substantially similar to the air-fuel ratio control device 1B described above with reference to FIG. 5. However, in a fuel flow rate control method of an electronic control carburetor 8B, an air pressure applied to a float void portion is regulated by an actuator 8*b* to control an air-fuel ratio. It is to be noted that the actuator 8*b* is a small-sized reciprocating type air pump, which is one type of linear solenoid actuator. When a similar control method is applied to the air-fuel ratio control device 1C as described above, precise air-fuel ratio feedback control is similarly realized.

Figure 7:
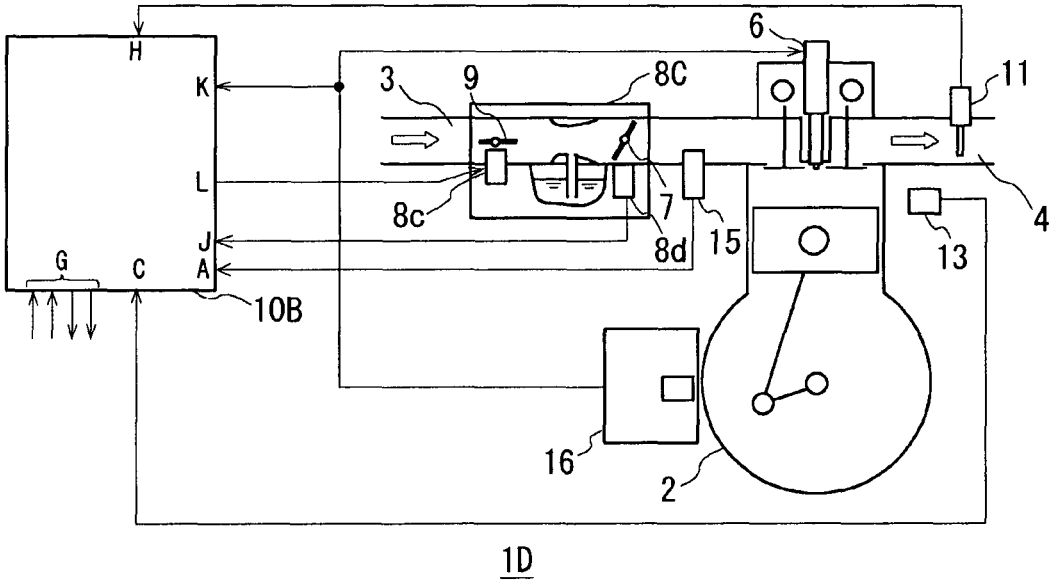
FIG. 7 is an arrangement diagram showing a constitution of still another application example of the air-fuel ratio control device of FIG. 1.

FIG. 7 shows an air-fuel ratio control device 1D as still another application example. This device also has a constitution substantially similar to the air-fuel ratio control device 1B described above with reference to FIG. 5. However, in a fuel flow rate control method of an electronic control carburetor 8C, a fuel flow rate is regulated by an actuator 8*c* which operates a choke valve 9 disposed on an upstream side from a main fuel passage, to control an air-fuel ratio in this example. The actuator 8*c* is constituted of a rotary solenoid or a step motor. When a similar control method is applied to the air-fuel ratio control device 1D as described above, precise air-fuel ratio feedback control can similarly be realized.

As described above, according to the present invention in which an exhaust gas temperature sensor is used in place of an air-fuel ratio sensor and control is executed while estimating an air-fuel ratio, feedback control of the air-fuel ratio by an excessively rich region can accurately be executed with an inexpensive system.

What is claimed is:

1. An air-fuel ratio control device comprising: fuel supply means; engine operation state detection means; air-fuel ratio information detection means; and an electronic control unit, the electronic control unit being configured to determine a fuel injection amount which realizes a target air-fuel ratio while using engine load information by the engine operation state detection means on the basis of air-fuel ratio information by the air-fuel ratio information detection means, and then output a driving signal to the fuel supply means, to execute feedback control mainly at an excessively rich side air-fuel ratio, wherein the air-fuel ratio information detection means is an exhaust gas temperature sensor, and while estimating an air-fuel ratio at this time on the basis of detected exhaust gas temperature information by a predetermined obtaining method, the air-fuel ratio is used for the control.

2. The air-fuel ratio control device according to claim 1, wherein the air-fuel ratio is obtained on the basis of the exhaust gas temperature information by use of a map or a formula beforehand obtained on the basis of the result of acquired information on an exhaust gas temperature and the air-fuel ratio at this time in a plurality of engine operation states with respect to a target engine, beforehand stored in storage means of the electronic control unit, and indicating a relation between the exhaust gas temperature and the air-fuel ratio.

3. The air-fuel ratio control device according to claim 2, wherein for the feedback control, the exhaust gas temperature during an operation at the target air-fuel ratio is estimated and calculated by two-dimensional interpolation or a polynomial approximate formula to obtain a target temperature, on the basis of engine rotation number information and a plurality of pieces of engine load information, and the feedback control is executed while regulating a fuel supply amount so that the exhaust gas temperature converges to the target temperature.

4. The air-fuel ratio control device according to claim 3, further comprising: engine temperature detection means, wherein an engine warm-up level is estimated and calculated on the basis of detected engine temperature information by one-dimensional interpolation or a polynomial approximate formula, and is add to or subtracted from the calculated target temperature, to correct the target temperature.

5. The air-fuel ratio control device according to claim 3, which calculates the exhaust gas temperature varying with the target air-fuel ratio by one-dimensional interpolation or a polynomial approximate formula, and adds or subtracts the exhaust gas temperature to or from the calculated target temperature, to correct the target temperature.

6. The air-fuel ratio control device according to claim 3, which subjects the calculated target temperature to response delay processing identified with a primary delay plus dead time system, by use of a time constant calculated on the basis of the engine rotation number information and the engine load information by two-dimensional interpolation or a polynomial approximate formula.

7. The air-fuel ratio control device according to claim 3, which judges that the engine is being warmed up to stop the execution of the feedback control, in a case where the calculated target temperature is lower than a predetermined temperature.

8. The air-fuel ratio control device according to claim 3, which judges that the engine causes an accidental fire to stop the execution of the feedback control, in a case where in the detected engine rotation number information, a rotation fluctuation is larger than a predetermined reference.

9. The air-fuel ratio control device according to claim 3, wherein the fuel supply means is an electronic control carburetor including an actuator operating type fuel flow ratio regulating section operated by the electronic control unit.

10. The air-fuel ratio control device according to claim 2, wherein the fuel supply means is an electronic control carburetor including an actuator operating type fuel flow ratio regulating section operated by the electronic control unit.

11. The air-fuel ratio control device according to claim 1, wherein for the feedback control, the exhaust gas temperature during an operation at the target air-fuel ratio is estimated and calculated by two-dimensional interpolation or a polynomial approximate formula to obtain a target temperature, on the basis of engine rotation number information and a plurality of pieces of engine load information, and the feedback control is executed while regulating a fuel supply amount so that the exhaust gas temperature converges to the target temperature.

12. The air-fuel ratio control device according to claim 11, further comprising: engine temperature detection means, wherein an engine warm-up level is estimated and calculated on the basis of detected engine temperature information by one-dimensional interpolation or a polynomial approximate formula, and is add to or subtracted from the calculated target temperature, to correct the target temperature.

13. The air-fuel ratio control device according to claim 11, which calculates the exhaust gas temperature varying with the target air-fuel ratio by one-dimensional interpolation or a polynomial approximate formula, and adds or subtracts the exhaust gas temperature to or from the calculated target temperature, to correct the target temperature.

14. The air-fuel ratio control device according to claim 11, which subjects the calculated target temperature to response delay processing identified with a primary delay plus dead time system, by use of a time constant calculated on the basis of the engine rotation number information and the engine load information by two-dimensional interpolation or a polynomial approximate formula.

15. The air-fuel ratio control device according to claim 11, which judges that the engine is being warmed up to stop the execution of the feedback control, in a case where the calculated target temperature is lower than a predetermined temperature.

16. The air-fuel ratio control device according to claim 11, which judges that the engine causes an accidental fire to stop the execution of the feedback control, in a case where in the detected engine rotation number information, a rotation fluctuation is larger than a predetermined reference.

17. The air-fuel ratio control device according to claim 11, wherein the fuel supply means is an electronic control carburetor including an actuator operating type fuel flow ratio regulating section operated by the electronic control unit.

18. The air-fuel ratio control device according to claim 1, wherein the fuel supply means is an electronic control carburetor including an actuator operating type fuel flow ratio regulating section operated by the electronic control unit.

* * * * *